US007290512B2

(12) United States Patent
Murata

(10) Patent No.: US 7,290,512 B2
(45) Date of Patent: Nov. 6, 2007

(54) VARIABLE VALVE APPARATUS OF INTERNAL COMBUSTION ENGINE

(75) Inventor: Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 66 days.

(21) Appl. No.: 11/375,098

(22) Filed: Mar. 15, 2006

(65) Prior Publication Data

US 2006/0236961 A1 Oct. 26, 2006

(30) Foreign Application Priority Data

Mar. 18, 2005 (JP) ..... P2005-079859

(51) Int. Cl.
*F01L 1/34* (2006.01)

(52) U.S. Cl. ..... 123/90.16; 123/90.39; 123/90.44

(58) Field of Classification Search ..... 123/90.16, 123/90.2, 90.27, 90.31, 90.6, 90.39, 90.44; 74/559, 567, 569

See application file for complete search history.

(56) References Cited

U.S. PATENT DOCUMENTS 7,168,404 B2 * 1/2007 Murata ..... 123/90.16

FOREIGN PATENT DOCUMENTS

JP 2003-239712 A 8/2003

* cited by examiner

*Primary Examiner*—Ching Chang
(74) *Attorney, Agent, or Firm*—Birch, Stewart, Kolasch & Birch, LLP

(57) ABSTRACT

A variable valve apparatus of an internal combustion engine includes a cam shaft, a drive cam formed integrally with the cam shaft, and a rocker arm mechanism for transmitting an opening/closing force from an operating end portion thereof to an intake or an exhaust valve by receiving the opening/closing force by a drive cam opposed roller brought into contact with the drive cam. For displacing a lift time period, in which the drive cam opposed roller receives the opening/closing force, frontward/rearward in a direction of rotating the drive cam, an up section of a cam lift face of the drive cam is formed to be longer than a down section thereof such that a change region of a lift valve closing time point of the lift time period becomes larger than a change region of a lift valve opening time point thereof.

6 Claims, 8 Drawing Sheets

VARIABLE VALVE APPARATUS OF INTERNAL COMBUSTION ENGINE

CROSS REFERENCE TO RELATED APPLICATION

This non-provisional application incorporates by reference the subject matter of Application No. 2005-079859 filed in Japan on Mar. 18, 2005, on which a priority claim is based under 35 U.S.C. §119(a).

BACKGROUND OF THE INVENTION

1. Field of the Invention

The present invention relates to a variable valve apparatus of an internal combustion engine for making a phase of driving and a lift amount of an intake or an exhaust valve variable.

2. Description of the Related Art

An engine which is an internal combustion engine mounted to an automobile is mounted with a variable valve apparatus for changing opening and closing timings constituting a phase of driving an intake/exhaust valve and a lift amount thereof in accordance with an operation state of the automobile for reason of a countermeasure against emission gas of the engine, a reduction in fuel cost or the like.

There is such a variable valve apparatus in which a moving displacement at a base section and a lift section of a cam face of a drive cam integrally formed with a cam shaft is converted to a displacement in a rocking cam moving direction of a rocking cam face in which a base section and a lift section are continuous. According to rocking cams used in such a variable valve apparatus, in many cases, a region at which the rocking cam face at a rocking end and a rocker arm roller on a side of a rocker arm are made to be able to be adjusted variably by shifting a rocking range of the rocking cam by driving a fulcrum moving mechanism in a rocker arm mechanism.

In this case, opening/closing timings constituting a mode of driving an intake or an exhaust valve and a lift amount thereof are adjusted by shifting a lift section rate at which the base section and the lift section constituting the rocking cam face and the rocker arm roller are opposed to each other in accordance with the operation state of the automobile.

As an example thereof, there is a rocker arm mechanism including a variable axially supporting member which is switched to vary by a drive source, a middle arm a fulcrum side of which is axially supported by the variable axially supporting member and a rocking side of which is rocked by being brought into contact with the drive cam, and the rocking cam a fulcrum side of which is axially supported by the supporting shaft and which is rocked by receiving a press force from the middle arm being proximate thereto by an input point for pressing the rocker arm roller on a side of the rocker arm by the rocking cam face at the rocking end. By operating to switch the variable axially supporting member in the rocker arm mechanism, a drive cam opposed roller of the middle arm is moved frontward/rearward in a direction of rotating the drive cam, thereby, a lift section of the middle arm is displaced. That is, the input point of the opening/closing operating force of the middle arm to the rocking cam is changed in a lift direction, in corporation therewith, a rocking region in which the rocker arm roller on the side of the rocker arm is opposed to the lift section on the rocking cam face for transmitting the opening/closing operating force is changed. In this way, the rocker arm mechanism adjusts the opening/closing timings and the lift amount constituting the mode of driving the intake or the exhaust valve moved in corporation with the rocker arm by operating to move the drive cam opposed roller in the direction of rotating the drive cam.

FIG. 9 shows an example of a displacement diagram showing an amount of operating a driven member driven by the drive cam of the rocker arm mechanism.

Here, a bold line CH1 shows a diagram showing an amount of operating the driven member when the drive cam opposed roller of the middle arm is shifted to a delay side constituting the direction of rotating the drive cam by operating the variable axially supporting member of the rocker arm mechanism. Further, a broken line CH2 shows a diagram showing the amount of operating the driven member when the drive cam opposed roller of the middle arm is shifted relative to the bold line CH1 by an advance amount R0 on an advance side (left side of FIG. 9) constituting a direction reverse to the direction of rotating the drive cam. By displacing to advance/delay the driven cam opposed roller on the side of the middle arm in the direction of rotating the drive cam in accordance with the operation of the variable axially supporting member, a maximum position of operation of the driven member can be shifted by R0. Further, by making the input point of the middle arm brought into contact with the rocking cam changeable, an amount of operating a lift height of the intake of the exhaust valve can be reduced to h2 by changing the rocking range of the rocking cam and preventing a predetermined cam height of the drive cam from being operated to the intake or the exhaust valve. Therefore, lift amount displacement regions E1, E2 of the intake or the exhaust valve moved in corporation with the rocker arm are shifted from each other and an amount h1, h2 operating a lift start point e1 and a lift finish point e2 and the lift height is changed to increase/decrease.

Incidentally, there is a variable valve apparatus for shifting a rate of making a rocker arm roller on a side of a rocker arm opposed to a base section and a lift section on a rocking cam face of a rocking cam (refer to JP-A-2003-239712).

Meanwhile, as is apparent from the cam lift amount displacement diagram shown in FIG. 9, by a difference in the advance amount R0 or a cam shape, widths of a change region ea of the lift start point e1 and a change region eb of the lift finish point e2 in a crank angle direction are respectively changed.

Here, the width eb of the change region of the lift finish point e2 corresponds to a control width of the valve opening/closing timings by the rocker arm mechanism. The larger the width eb of the change region of the lift finish point e2, the easier the valve closing control to increase a variable response of a valve closing timing. Particularly, in the case of the intake valve, by making an output control easy by making the valve closing timing related to a charging efficiency variable considerably, it is regarded to be effective in view of a valve closing control to increase the width eb of the change region of the lift finish point e2.

SUMMARY OF THE INVENTION

The invention has been carried out in view of the above-described problem and it is an object of the invention to provide a variable valve apparatus of an interval combustion engine capable of facilitating a valve closing control and promoting variable response of a valve closing timing by increasing a change region of a lift finish point in controlling a lift amount of a rocker arm.

In order to achieve the above-described object, there is provided a variable valve apparatus of an internal combustion engine, the variable vale apparatus including a cam shaft rotatably provided to the internal combustion engine, a drive cam formed integrally with the cam shaft, and a rocker arm mechanism for transmitting an opening/closing operating force from an operating end portion thereof to an intake or an exhaust valve of the internal combustion engine by receiving the opening/closing operating force by a drive cam opposed roller brought into contact with the drive cam, for displacing a lift time period in which the drive cam opposed roller receives the opening/closing operating force by the rocker arm mechanism frontward/rearward in a direction of rotating the drive cam, an up section of a cam lift face of the drive cam is formed to be longer than a down section thereof such that a change region of a lift valve closing time point of the lift time period becomes larger than a change region of a lift valve opening time point thereof.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
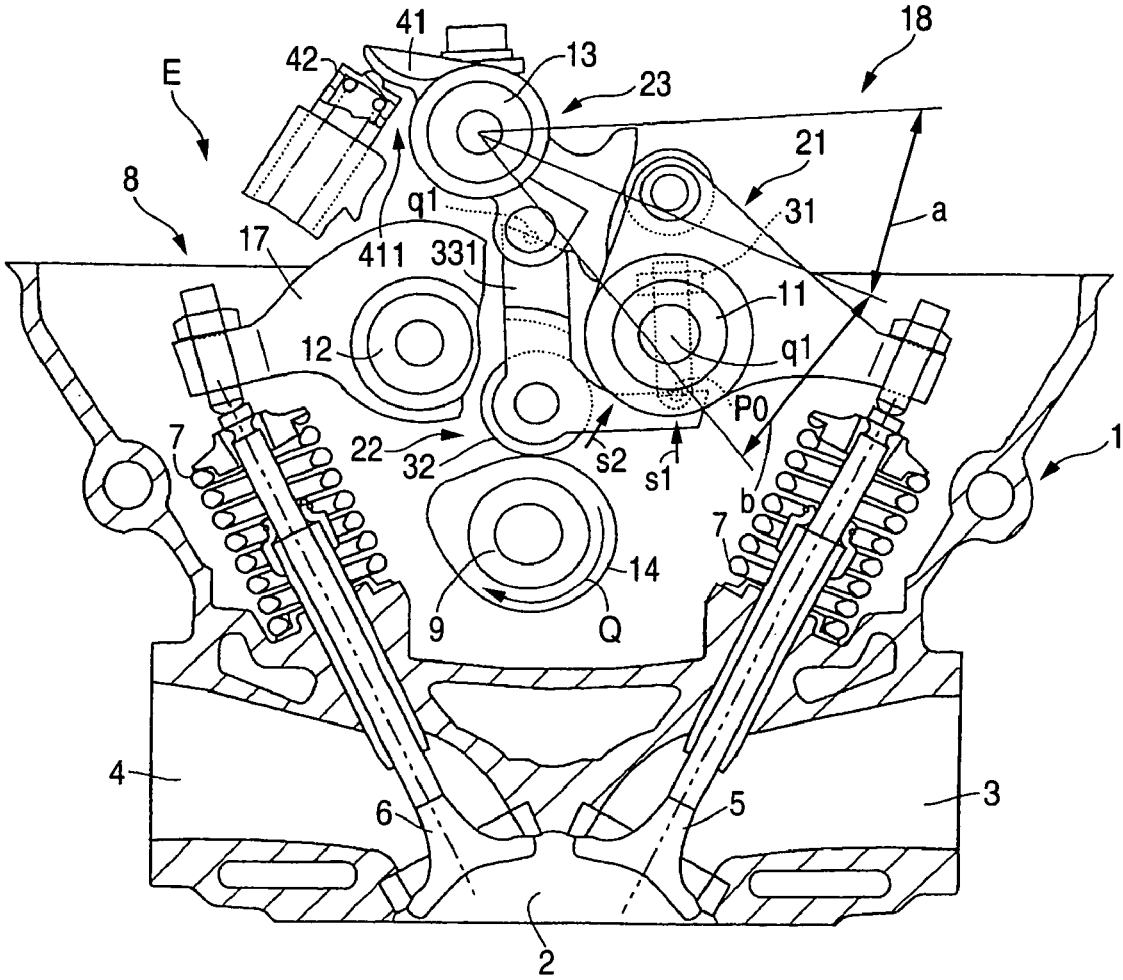
FIG. 1 is a side sectional view of a cylinder head of an engine having a variable valve apparatus of an interval combustion engine according to an embodiment of the invention.

FIG. 1 shows a cylinder head 1 of a four cylinder reciprocal gasoline engine (hereinafter, simply described as engine E) to which a variable valve apparatus of an interval combustion engine according to an embodiment of the invention is applied. A lower face of the cylinder head 1 is overlapped with a cylinder block, not illustrated, to be fastened to each other, and combustion chambers 2 are successively formed along an alignment of a plurality (for example, four) of cylinders along a longitudinal direction X of the cylinder head 1 (a direction perpendicular to the sheet of FIG. 1). Each combustion chamber 2 is provided with two (a pair) of intake ports 3 and exhaust ports 4 (only one sides thereof are illustrated). Further, an upper portion of the cylinder head 1 is provided with an intake valve 5 for opening/closing the intake port 3 and an exhaust valve 6 for opening/closing the exhaust port 4. Further, each of the plurality of intake valves 5 and the plurality of exhaust valves 6 are mounted with valve springs 7 for urging the respective valves in closing directions. Further, the upper portion of the cylinder head 1 is equipped with a variable valve apparatus 8 as a valve system of SOHC type for driving the plurality of intake valves 5 and the plurality of exhaust valves 6.

The variable valve apparatus 8 is provided with a rotatable cam shaft 9 in the longitudinal direction (the direction perpendicular to the sheet of FIG. 1) above the cylinder head 1 and right above the combustion chamber 2. One end of the cam shaft 9 is connected with a timing pulley, not illustrate. The timing pulley is transmitted with rotation of an engine crankshaft, not illustrated, thereby, the cam shaft is driven to drive to open/close an intake cam 14 and an exhaust cam 15.

Figure 2:
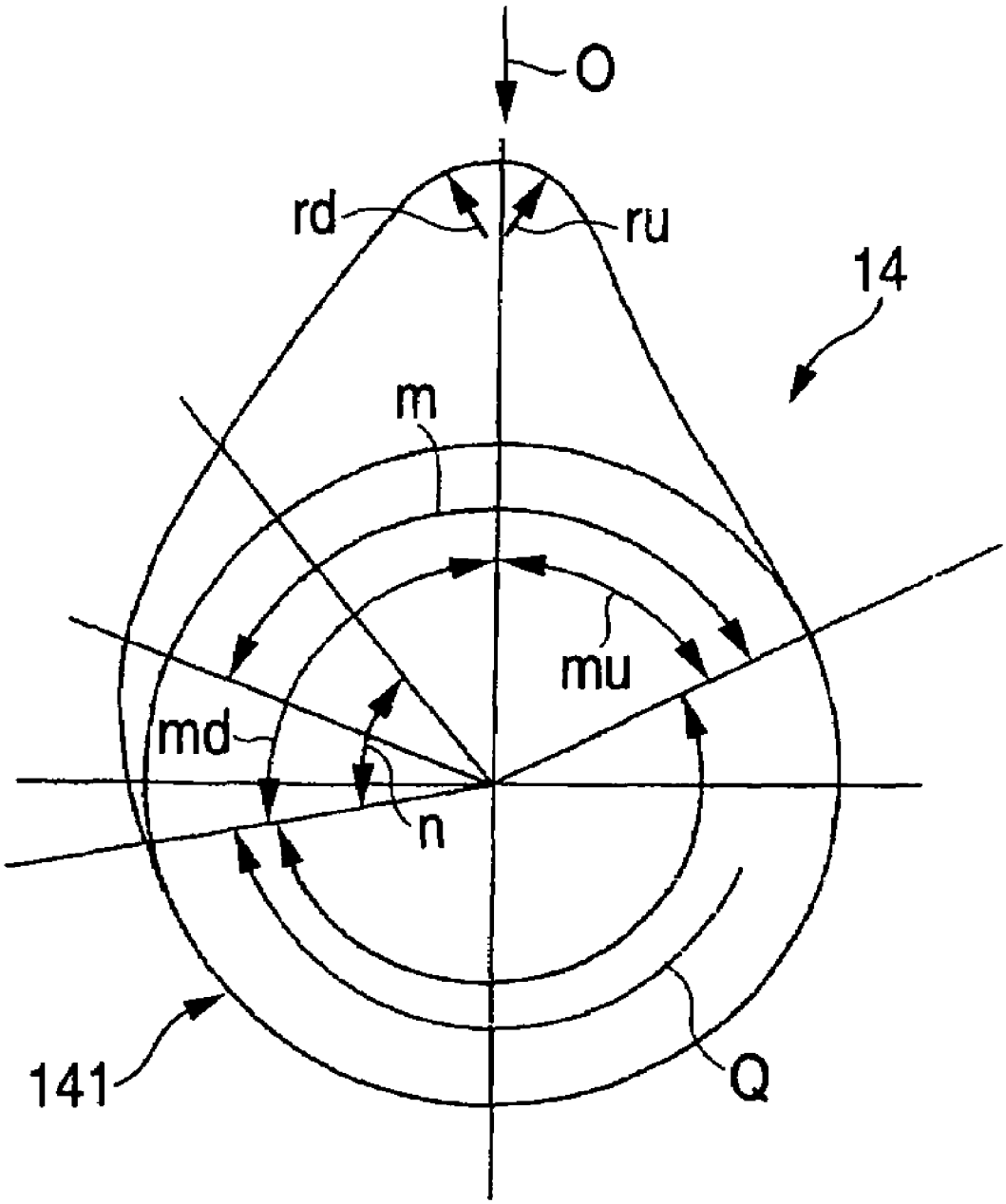
FIG. 2 is an enlarged side view of an intake cam used in the variable valve apparatus of the interval combustion engine of FIG. 1.

The cam shaft 9 of the variable valve apparatus 8 is arranged with a rocker shaft 11 on an intake side and a rocker shaft 12 on an exhaust side, which are rotatable and in parallel with the cam shaft 9 on left and right sides (left and right sides in a width direction of the cylinder head) of the upper portion interposing the cam shaft 9. A region on an upper side between the rocker shaft 11 and the rocker shaft 12 is provided with a supporting shaft 13 substantially in parallel with the cam shaft 9. As shown in FIG. 2, the intake cam 14 and the exhaust cam 15 as drive cams are formed at each portion of the camshaft 9 opposed to each combustion chamber 2. Specifically, the intake cam 14 is formed at a center point right above the combustion chamber 2, and the exhaust cams 15 are formed on both sides interposing the intake cam 14.

The rocker shaft 12 on the exhaust side is pivotably provided with a rocker arm 17 (only one side of which is illustrated in FIG. 1) for driving the exhaust valve 6 for each exhaust cam 15. The rocker shaft 11 on the intake side is provided with a rocker arm mechanism 18 for driving the plurality (pair) of intake valves 5 altogether for each intake cam 14. There is formed the variable valve apparatus 8 for opening/closing the intake valve 5 and the exhaust valve 6 by the exhaust side and the intake side mechanisms at each predetermined combustion cycle (4 cycles of intake stroke, compression stroke, explosion stroke, exhaust stroke) by rotating the single cam shaft 9.

Here, as shown in FIG. 2, according to the intake cam 14 as the drive cam, a cam face 141 has a base section n and a cam lift section m. In the cam face 141, a down section md of returning to the base section n from a cam top O is set to be longer than an up section mu for reaching the cam top O from the base section n. Further, a curvature of a cam projected face of the cam top O is set to be smaller on the down section side than on the up section side mu, that is, a radius of curvature thereof is set to be larger on the down section side md than on the up section side mu.

Figure 3:
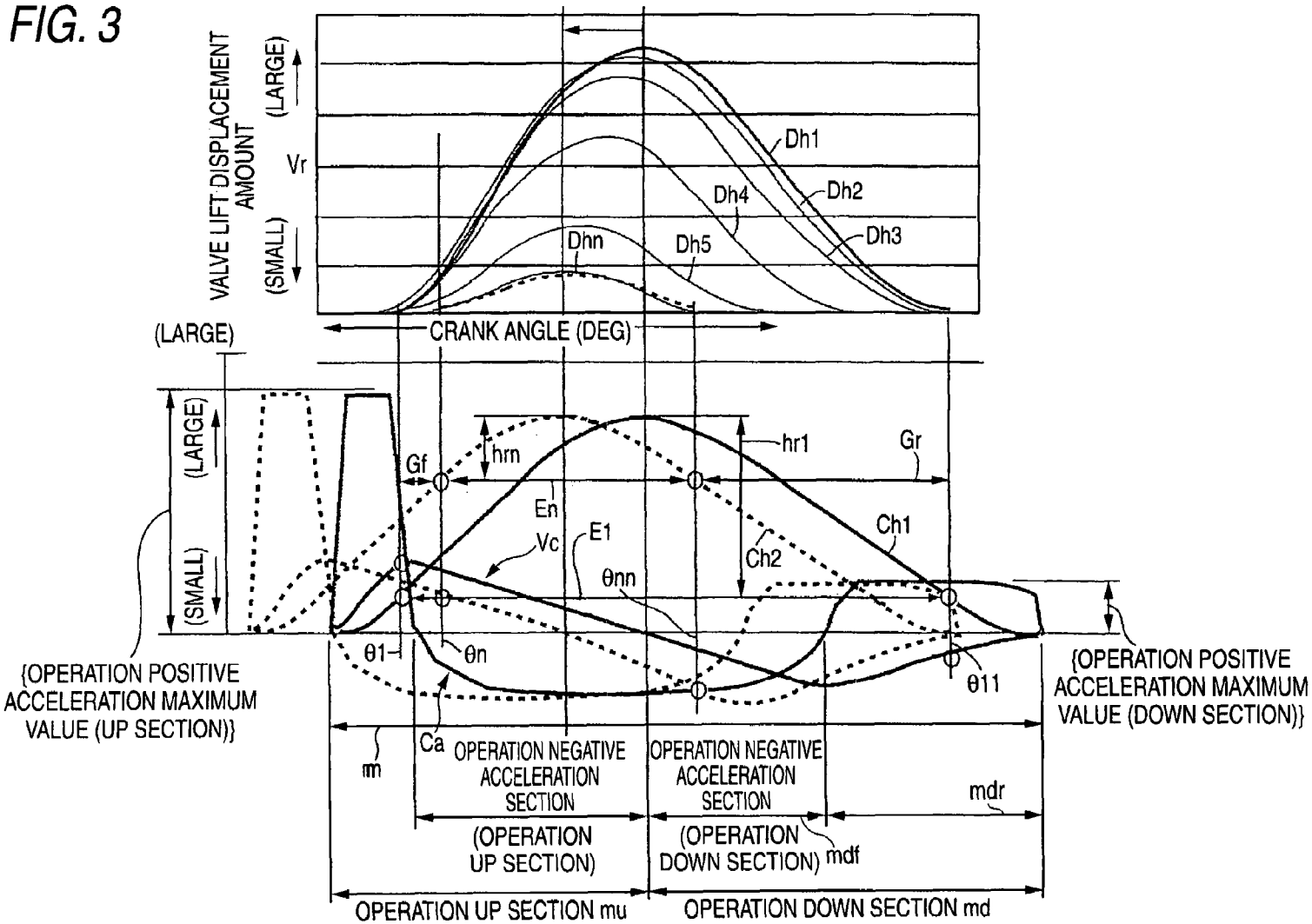
FIG. 3 is an explanatory view of an operation characteristic of the variable valve apparatus of the interval combustion engine of FIG. 1, specifically, a valve lift displacement amount diagram of the intake cam, a speed and acceleration diagram of operating a driven member, a lift displacement amount diagram.
Figure 8:
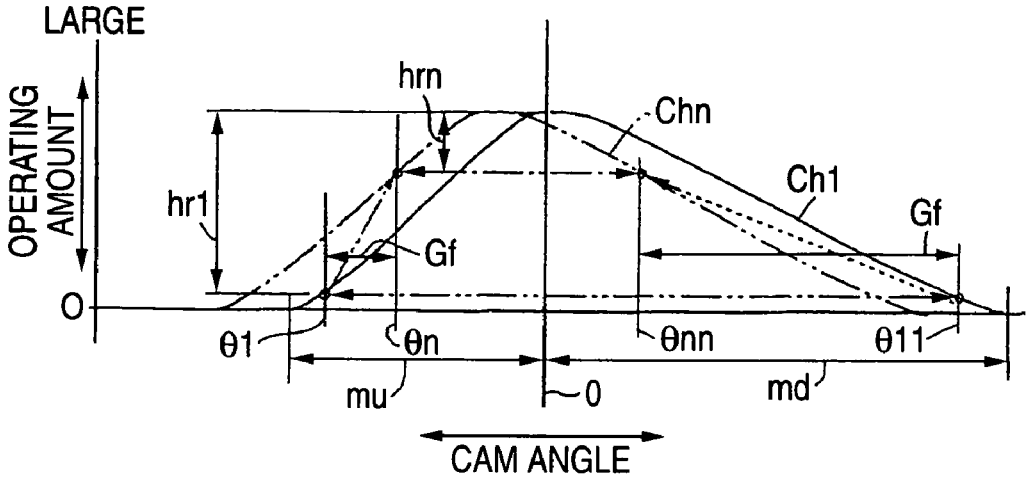
FIG. 8 is an explanatory view of an operational characteristic of the driven member driven by the variable valve apparatus.
Figure 9:
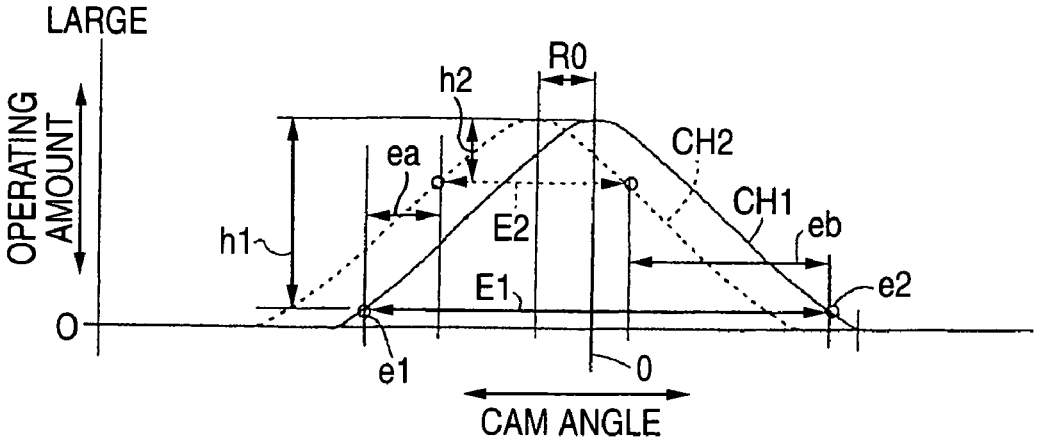
FIG. 9 is an explanatory view of an operational characteristic of a driven member driven by a variable valve apparatus of a related art.

Incidentally, an amount of operating a member driven by the cam face 141 is designated by notation Ch1 in FIG. 3, and FIG. 8 shows a schematic view of a diagram Ch1. As is apparent from the diagrams of FIG. 2 and FIG. 8, the cam radius of curvature ru of the up section side mu of the cam face 141 is set to be comparatively small and therefore, a lift amount curve of the up section mu reaching the cam top O from the base section n continuous thereto can be formed to be comparatively short. Further, the cam projected face curvature at a vicinity of the cam top is set to be smaller on the down section side than on the up section side, that is, the cam radius curvature is set to be comparatively large on the down section side md (>mu) and therefore, the lift amount curve of the down section md reaching the cam top O from the base section n continuous thereto can be formed to be comparatively long. Incidentally, operation and effect thereby will be described later.

Next, FIG. 3 shows a specific example of a characteristic of the cam face 141 of FIG. 2. Here, a difference between the down section side md formed to be comparatively long and the up section mu formed to be comparatively short is set to be about 20 degrees (=md−mu) by a cam angle.

Here, FIG. 3 shows an operating speed Vc of a driven member provided based on the cam face 141 having the operating amount Ch1 of the driven member, and an operating acceleration Ca of the driven member. The operating speed Vc of the driven member is set to increase/decrease by a positive value in the up section side mu and increase/decrease by a negative value in the down section side md. The operating acceleration Ca in accordance with the operating speed Vc of the driven member shows a comparatively large positive value at lift initial time in the up section mu and maintains a constant negative value in the most main region. Further, the cam acceleration Ca continues to maintain substantially a constant negative value at a front section mdf of substantially the first half of the down section side md, and then is reversed at a post section mdr of substantially the second half and maintained substantially at a constant positive value. By the post section mdr, the operating speed Vc can be gradually reduced to converge to null to reduce impact at valve closing time.

Figure 4:
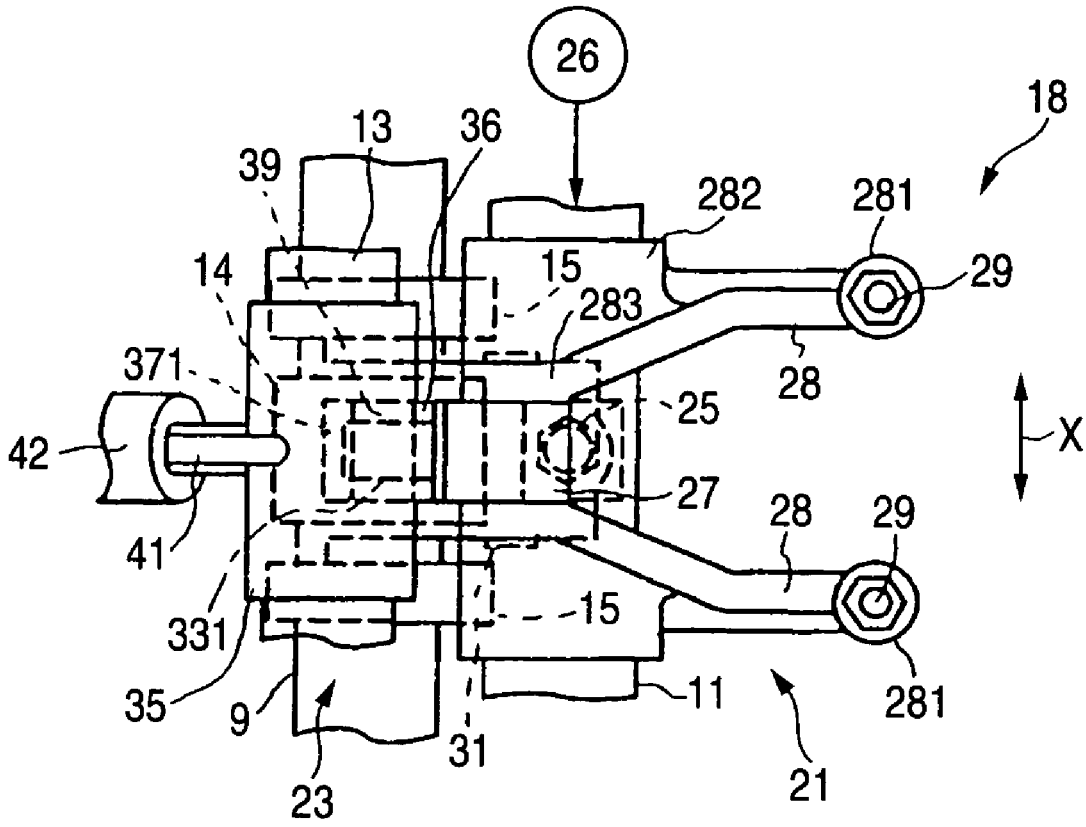
FIG. 4 is a plane view of a rocker arm mechanism used in the variable valve apparatus of the interval combustion engine of FIG. 1.
Figure 5:
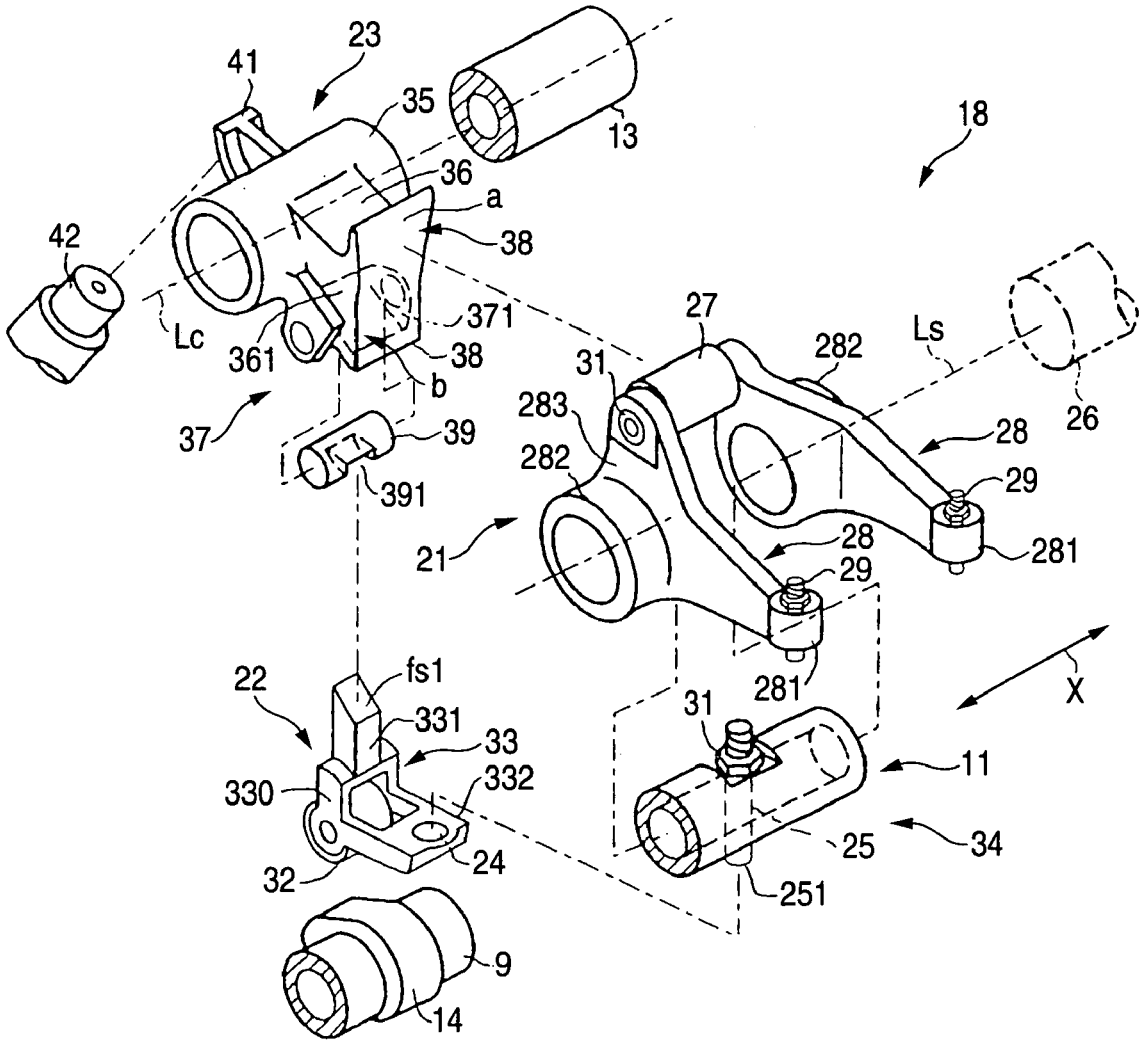
FIG. 5 is an exploded perspective view of the rocker arm mechanism in the variable valve apparatus of the internal combustion engine of FIG. 1.

FIG. 4 shows a plane of the rocker arm mechanism 18 for driving the intake valve 5 of the variable valve apparatus 8, and FIG. 5 shows an exploded perspective view of the rocker arm mechanism 18. The rocker arm mechanism 18 includes a rocker arm 21 (corresponding to first arm) in which a boss portion 282 constituting an axially supported end is rockably supported by the rocker shaft 11 on the intake side, a middle arm 22 (corresponding to second arm) driven by the intake cam 14 which is a drive cam, a swing cam 23 (corresponding to third arm) which is a rocking cam supported pivotably by the support shaft 13, a pin member 25 supported by the rocker shaft 11 constituting a fulcrum member in which a spherical portion 251 is fitted to a receiving portion 24 in a recess shape of the middle arm 22 for setting an axially supporting point p0, a motor 26 (refer to FIG. 4) for rocking the pin member 25 by way of the rocker shaft 11.

As shown in FIGS. 4 and 5, the rocker arm 21 (corresponding to first arm) includes a pair of respective rocker arm pieces 28 having boss portions 282 axially supported by the rocker shaft 11. The pair of respective rocker arm pieces 28 are extended with input end portions 283 for receiving a press force from the swing cam 23 (corresponding to third arm) to direct in a skewed upper direction from one sides of the boss portions 282. The pair of input ends 283 opposed to each other are integrally coupled each other by a short shaft 31. The short shaft 31 is outwardly fitted with a first roller 27 which is a rocker arm roller by way of a bearing motor module, not illustrated. A pair of operating ends 281 are extended from other sides of the bosses 282 of the pair of respective rocker arm pieces 28 for driving the intake valves 5. The intake valves 5 are brought into contact therewith by way of, for example, adjust screw portions 29.

An end portion of the rocker shaft 11 is connected to the motor 26 for control as a drive source, and the rocker shaft 11 is formed to be able to displace to pivot as desired by operating the motor 26. A portion disposed on the rocker shaft 11 and at the center between the pair of rocker arm pieces 28 is screwed to be inserted with the pin member 25 which is the fulcrum member formed with the spherical portion 251 at the lower end portion in a state of being penetrated in a diameter direction to be fastened by a nut 31. The rocker shaft 11 and the pin member 25 receive a switch operating force by driving the motor 26 to pivot the pin member 25 around a center line Ls of the rocker shaft 11 to form a fulcrum moving mechanism 34 capable of switching to displace the fulcrum position P0 frontward/rearward in the direction of rotating the intake cam 14 by pivoting to displace from an attitude of a delay position S1 at which the pin member 25 is vertically arranged (refer to FIGS. 1 and 6) to an attitude of an advance position S2 of being inclined in a direction of the cam shaft substantially by an angle of 45° (refer to FIG. 6).

As shown in FIGS. 1 and 5, the middle arm 22 which is a second arm includes a second roller 32 as a drive cam opposed roller brought into rolling contact with the cam face 141 of the intake cam 14 which is the drive cam, and a holder portion 33 (refer to FIG. 5) which is an L-shape member for rotatably supporting the second roller 32 at an axially supporting portion 330. Here, the holder portion 33 includes the axially supporting portion 330 which is a bent portion thereof and supporting the second roller 32, a relay arm portion 331 extended in a columnar shape from the axially supporting portion 330 to an upper side, specifically, to between the rocker shaft 11 and the supporting shaft 13, and a fulcrum arm portion 332 in a flat plate shape extended from a side portion of the axially supporting portion 330 to a lower side of the rocker shaft 11. In this manner, the holder portion 33 is formed into the L shape.

A front end (upper end portion) of the relay arm portion 331 is formed with an inclined face fs1 constituting an input point (relay) for transmitting displacement to the swing cam 23. Here, at the inclined face fs1 is inclined such that a side (right side of FIG. 6) of the fulcrum arm portion 332 is lower and a side (left side of FIG. 6) of the supporting shaft 13 is higher.

Figure 7:
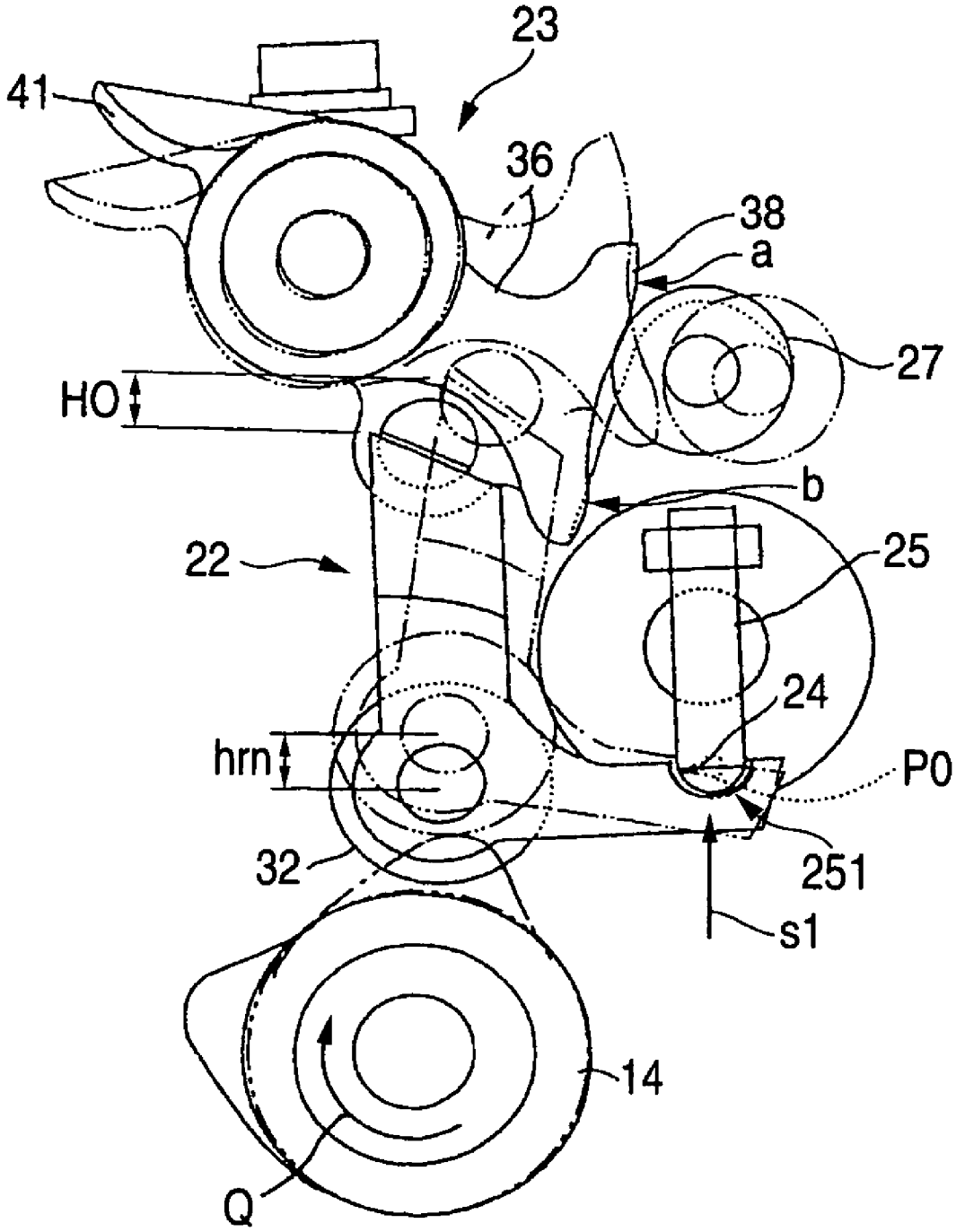
FIG. 7 is an explanatory view of operating a lift displacement of the middle of the rocker arm mechanism in FIG. 1.

On the other hand, a projected end of the fulcrum arm portion 332 is formed with the spherical receive portion 24 to which the spherical portion 251 of the pin member 25 supported by the rocker shaft 11 is fitted relatively displaceably. Here, when the intake cam 14 is rotated by one rotation, the middle arm 22 the second roller 32 of which is brought into contact with the intake cam is moved comparatively therewith, the middle arm 22 is reciprocally pivoted by one reciprocation in an up and down direction centering on the axially supporting point P0 formed by fitting the spherical portion 251 of the middle arm 22 to the receive portion 24 supported by the rocker shaft 11. At that occasion, as shown in FIG. 7, a position of the relay arm portion 331 is pivoted by an up and down displacement amount H0.

Figure 6:
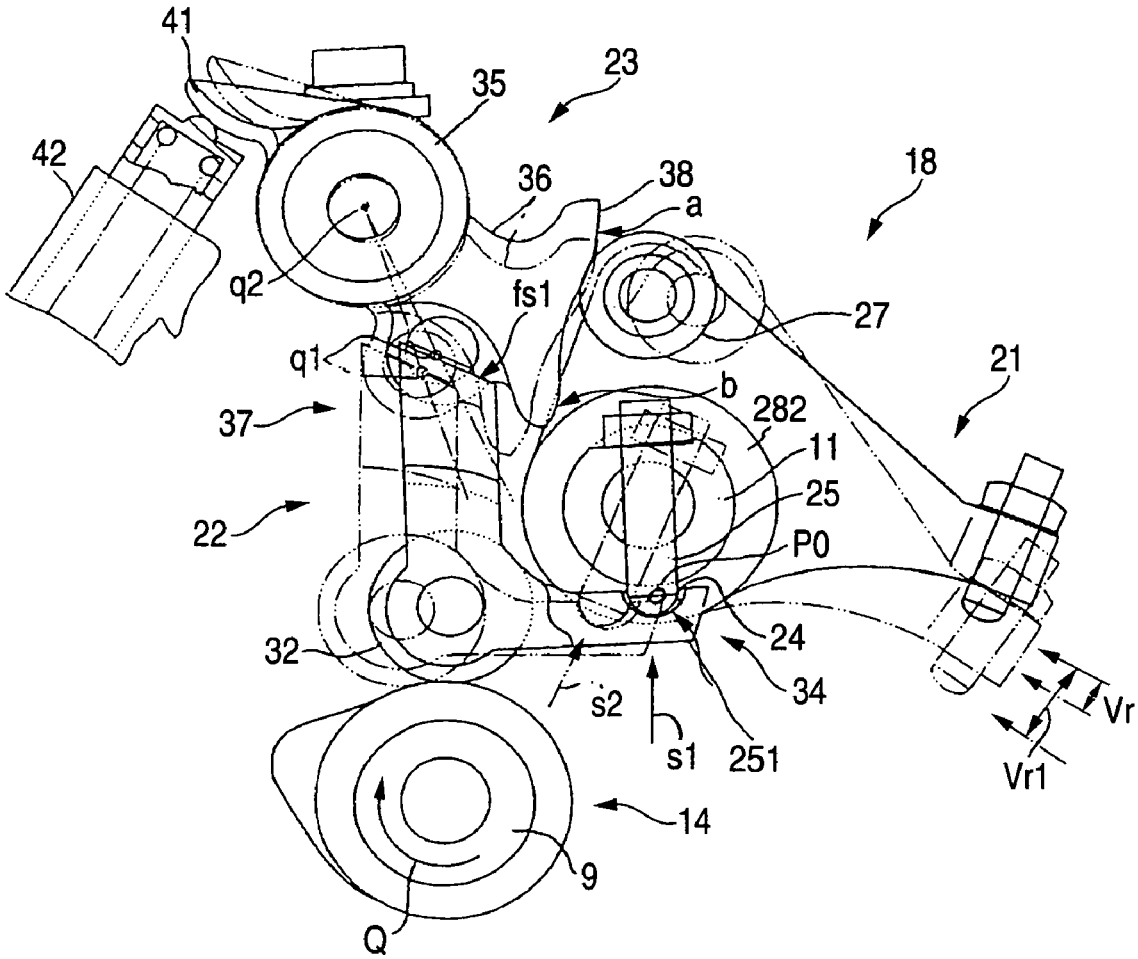
FIG. 6 is an explanatory view of operating to advance and delay a middle arm of the rocker arm mechanism in FIG. 1.

That is, by enabling the pivotably supporting point P0 of the middle arm 22 on the side of the rocker shaft 11 to move in a direction intersecting with an axial direction of the shaft by the fulcrum moving mechanism 34, and utilizing a positional shift of the middle arm 22 provided by the movement, as shown in FIG. 6, the position of the second roller 32 brought into rolling contact with the intake cam 14 is made to be able to displace frontward/rearward in a direction Q of rotating the cam, that is, in an advance or a delay direction.

As shown in FIG. 1, FIG. 5 and FIG. 6, the swing cam 23 constituting the third arm includes a cylindrical boss 35

(axially supporting end portion) fitted to insert pivotably to the supporting shaft 13 as the supporting shaft arranged at a vicinity of an upper side of the cam shaft 9, an arm portion (rocking extended portion) 36 extended from the cylindrical boss 35 to the first roller 27 (side of the rocker arm 21), a displacement receive portion 37 formed at a lower portion of the arm portion 36 at a middle position in a direction of extending the arm portion 36 and constituting an input point q1, a rocking cam face 38 formed by a bulged portion 361 constituting a rocking end of the arm portion 36 and capable of exerting the press force to the first roller 27, and a spring receive portion 41 extended from a side face of the cylindrical boss 35 (axially supporting end portion) on a side opposed to the arm portion 36. Further, the spring receive portion 41 is brought into contact with a pusher 42 for exerting an elastic force for urging the middle arm 22 and the swing arm 23 in a direction of bringing the middle arm 22 and the swing arm 23 into close contact with each other.

The swing cam 23 is formed with the rocking cam face 38 at a rocking end of the arm portion 36. The rocking cam face 38 is formed to change to increase/decrease a distance d from the pivotably supporting point p0 constituting the center of the supporting shaft 13. As shown in FIG. 6, the pivoting cam face 38 is formed by a base circle section a on an upper side thereof and a lift section b on a lower side thereof. Here, the base circle section a is formed by a circular arc face in which a distance from an axially supporting point q2 coinciding with an axis center of the supporting shaft 13 is constant. The lift section b is formed as an opposite circular arc face continuous to the circular arc of the base circle section a in which a distance from the axially support point q2 is gradually increased.

As shown in FIG. 6, the displacement receive portion 37 at the lower portion of the arm portion 36 is disposed right above the cam shaft 9, formed with a recess portion 371 and axially attached with pivotably a short shaft 39 directed in a direction the same as that of the cam shaft 9 at inside of the recess portion 371. A recess portion 391 is formed at a lower portion of the short shaft 39 exposed from an opening portion of the recess portion 371. A front end portion of the relay arm portion 331 is inserted into the recess portion 391 in a state of being directed upward and the input point q1 is maintained by bringing the inclined face fs1 into contact with a bottom face of the recess portion 391 slidably.

As shown in FIG. 6, the input point q1 at which the inclined face fs1 is brought into contact with the bottom face of the recess portion 391 is formed to be able to displace simultaneously with advancing or delaying frontward/rearward in the direction Q of rotating the intake cam 14 by the second roller 32 of the middle arm 22 by the fulcrum moving mechanism 34. That is, the fulcrum moving mechanism 34 functions such that the position of bringing the inclined face fs1 and the bottom face of the recess portion 391 into contact with each other is moved to the upper side by moving to delay the middle arm 22 which is the second arm (move to the right side in FIG. 6), that is, the pivoting cam 38 of the swing cam 23 is pushed up, the first roller 27 is opposed to the lift section b at an earlier timing, that is, the valve lift amount hr1 (refer to FIG. 6) is corrected to increase.

Next, operation of the variable valve apparatus 8 constituted in this way will be explained. First, the cam shaft 9 and the intake cam 14 are rotated, the second roller 32 of the middle arm 22 is opposed to the base section n of the cam face 141, thereafter, opposed to the up section side mu of the cam lift section m, successively opposed to the down section side md by way of the cam top O, thereafter, opposed to the base section n again. In the cam lift section m at this occasion, the second roller 32 of the middle arm 22 is driven to be pressed. At this occasion, as shown in FIG. 7, the middle arm 22 is rocked by constituting a fulcrum by the axially supporting point P0 of the spherical portion 251 constituting a pivot on a side of the rocker shaft 11 by an up and down displacement amount hrn. The pivoting displacement is transmitted from the relay arm portion 331 of the middle arm 22 to the swing cam 23 disposed right thereabove. Here, the swing cam 23 is rocked to displace in the up and down direction after always maintaining a press contact state between the inclined face fs1 and the bottom face of the recess portion 391 by operating a returning spring force of the pusher 42. Here, the pivoting cam face 38 of the swing cam 23 is brought into rolling contact with the first roller 27 of the rocker arm 21, particularly, by pressing the first roller 27 in the lift section b, the pair of rocker arm pieces 28 of the rocker arm 21 are driven around the center line Ls of the rocker shaft 11 to simultaneously open/close the pair of intake valves 5.

In operating the variable valve apparatus 8 in this way, control means, not illustrated, calculates an optimum fulcrum position P0 in accordance with the operating state to drive the control motor 26 by an output in correspondence with the fulcrum position P0. Assume that the control motor 26 rotates the pin member 25 by way of the rocker shaft 11 and the fulcrum position P0 of the middle arm 22 is positioned to, for example, the delay position S1 providing the maximum valve lift amount hr1 as shown by the bold line in FIG. 6.

In this case, the inclined face fs1 of the relay arm portion 331 of the middle arm 22 moves up the swing cam 23 (corresponding to the third arm), the first roller 27 is brought into contact with the lift section b of the pivoting cam face 38 at a comparatively early timing (crank angle θ1 in FIG. 3), in the lift section E1, rocking in correspondence with the operating amount hr1 of the driven member is carried out along the lift displacement amount diagram Dh1 of the rocker arm 21, thereafter, the first roller 27 returns to the base section a of the rocking cam face 38 at a crank angle θ11 on the most delay side to finish rocking the rock arm 21 by one period. In this case, the intake valve 5 is controlled to open/close by a displacement characteristic similar to the lift displacement amount diagram Dh1 of the rocker arm 21.

Next, assume that in operating the variable valve apparatus 8, the pin member 25 is rotated by the control motor 26 by way of the rocker shaft 11, as shown by the broken line in FIG. 6, the fulcrum position P0 of the middle arm 22 is positioned at an advance position Sn providing the minimum operating amount hrn.

In this case, the inclined face fs1 of the relay arm portion 331 of the middle arm 22 moves down the swing cam 23, the first roller 27 is brought into contact with the lift section b of the rocking cam face 38 at a comparatively delay timing (crank angle θn in FIG. 3), rocking in correspondence with the operating amount hrn is carried out along the lift displacement amount Dhn, thereafter, the first roller 27 returns to the base section a of the rocking cam face 38 at crank angle θnn on the delay side to finish rocking the rocker arm 21 in one period. In this case, the intake valve 5 is controlled to open/close by a displacement characteristic similar to the lift displacement amount diagram Dhn of the rocker arm 21.

Further, in operating the variable valve apparatus 8, the control means, not illustrated, calculates the optimum fulcrum position in accordance with the operating state, the control motor 26 is driven by the output in correspondence with the fulcrum position P0, in accordance with the respective fulcrum positions P0, lift sections E1 through En at which the second roller 32 of the middle arm 22 is brought into contact with the intake cam 14 are controlled to be large or small as shown in FIG. 3, in accordance with a variation in the lift sections E1 through En, the lift displacement amount diagrams Dh1 through Dhn of the rocker arm 21 are controlled to be large or small as shown in FIG. 3.

Incidentally, although FIG. 3 shows only the lift sections E1, En, also in lift sections E2, E3, E4, E5, not illustrated, disposed at a middle thereof, in accordance with the respective lift sections, the operation in correspondence with the lift sections E1, En is carried out and illustration and duplicated explanation thereof will be omitted here. Similarly, although FIG. 3 shows the lift displacement amount diagrams Dh2, Dh3, Dh4, Dh5, other than the lift displacement amount diagrams Dh1 through Dhn, disposed at a middle portion thereof, also in these case, the operation in correspondence with the lift displacement amount diagrams Dh1 through Dhn is carried out and duplicated explanation thereof will be omitted here.

As described above, according to the variable valve apparatus 8 of FIG. 1, in accordance with the state of operating the engine, the optimum fulcrum position P0 is calculated previously by the control mean, the middle arm 22 is pivoted to displace at the fulcrum position P0, and in accordance with the respective fulcrum positions P0, the lift displacement amount Vr of the rocker arm in correspondence with the lift displacement amount diagrams Dh1 through Dhn, that is, the valve lift amount of the intake valve 5 can be provided.

According to the variable valve apparatus 8 of FIG. 1, in the cam lift face 141 of the intake cam 14, the down section side md is set to be longer than the up section mu and therefore, in accordance with displacing the lift time period E frontward/rearward in the direction Q of rotating the intake cam 14 by the rocker arm mechanism 18, the lift displacement amount diagrams Dh1 through Dhn are switched, and change regions Gr of the valve closing timings θnn through θ11 in accordance with the lift displacement amount diagrams can be set to be sufficiently large.

In this way, the change region Gr of the valve closing timing of the intake or the exhaust valve can more be made to be variable and therefore, the valve closing control is facilitated, the variable response of the valve closing timing is further promoted, the output control is further facilitated, and the engine control ability is further promoted. Particularly, in the case of the intake valve 5 driven by the intake cam 14, the output control by making the valve closing timing related to the charge efficiency considerably variable is facilitated and the engine controllability is promoted. Further, since the variable response is promoted, a performance of converging to a target control value in control is promoted and the fuel cost is improved.

Further, the change regions G (timings) of the valve opening timings θnn through θ11 can considerably be made to be variable and therefore, when a phase variable mechanism, not illustrated, is also installed separately between the variable valve apparatus 8 applied with the apparatus and a crankshaft of the engine, not illustrated, an amount of operating the phase variable mechanism is reduced, the variable response, the performance of converging to the target control value are promoted and the fuel cost is improved. In addition thereto, the variable range of the phase variable mechanism is reduced, a generally used phase variable apparatus can be utilized, and a reduction in cost can be achieved.

According to the variable valve apparatus 8 of FIG. 1, in addition to forming the down section side md longer than the up section mu in the cam lift face 141 of the intake cam 14, the cam projected face curvature at a vicinity of the cam top O is set to be small on the down section side than on the up section side and therefore, when the lift time period E is switched to displace frontward/rearward in the direction of rotating the intake cam 14 (drive cam) by the rocker arm mechanism 18, a change region Gr of the valve opening timing θ11 can be set to be larger than a change region Gf of the lift valve opening timing θ1 in the lift time period E. Thereby, the control for making the valve closing timing of the intake or the exhaust valve 5, 6 further considerably variable is facilitated, the variable response of the valve closing timing is further promoted, the output control is further facilitated, and the engine controllability is further promoted.

Further, according to the variable valve apparatus 8 of FIG. 1, in the intake cam 14 brought into contact with the cam lift face 141, in the post section mdr of substantially ½ of the down section side md, by the operating positive acceleration Ca having substantially the constant comparatively small value, that is, the operating speed Vc can gradually be reduced to converge to null and therefore, the impact in valve closing time can be reduced.

Further, according to the variable valve apparatus 8 of FIG. 1, the rocker arm mechanism 18 explained in reference to FIG. 4, FIG. 5 is used and therefore, the control of displacing the cam lift section m frontward/rearward in the direction Q of rotating the intake cam 14 (drive cam) can firmly be carried out.

Further, the valve speed in seating the valve or inserting to lift is determined by synthesizing the drive cam and the locking cam, and in a case in which the cam region used in valve seating or in starting to lift on the side of the pivoting cam is made to always stay the same, the case needs to be dealt therewith on the side of the drive cam. In this case, by making the down side of the drive cam smooth, the seating acceleration can be restrained and the seating impact can be alleviated.

Incidentally, although in the above-described, an explanation has been given such that the drive cam is constituted by the intake cam 14, the drive cam may be the exhaust cam, also in this case, the engine controllability is promoted, the performance of converging to the target control value in control is promoted and the fuel cost is improved. Further, the seating impact in valve closing time is larger in the case of high rotation and high lift and therefore, the valve may be set to be seated in a section of the operating positive acceleration Ca having at least substantially a constant comparatively small value in middle or high lift.

The invention claimed is:

1. A variable valve apparatus of an internal combustion engine, the variable vale apparatus comprising:

a cam shaft rotatably provided to the internal combustion engine, a drive cam formed integrally with the cam shaft, and a rocker arm mechanism for transmitting an opening/closing operating force from an operating end portion thereof to an intake or an exhaust valve of the internal combustion engine by receiving the opening/closing operating force by a drive cam opposed roller brought into contact with the drive cam;

wherein for displacing a lift time period, in which the drive cam opposed roller receives the opening/closing operating force by the rocker arm mechanism, frontward/rearward in a direction of rotating the drive cam, an up section of a cam lift face of the drive cam is formed to be longer than a down section thereof such that a change region of a lift valve closing time point of the lift time period becomes larger than a change region of a lift valve opening time point thereof.

2. The variable valve apparatus of an interval combustion engine according to claim 1, wherein a cam projected face curvature at a vicinity of a cam top of the drive cam is set to be smaller on a side of the down section than on a side of the up section.

3. The variable valve apparatus of an internal combustion engine according to claim 1, wherein in the down section of the cam lift face of the drive cam, a post section of the down section is formed by a shape by which an amount of operating a member driven by the drive cam can maintain a positive acceleration having substantially a constant value.

4. The variable valve apparatus of an internal combustion engine according to claim 1, wherein the rocker arm mechanism comprises:

a first arm pivoted around a fulcrum position by receiving a press force by an axially supported rocker arm roller for driving the intake or the exhaust valve brought into contact with the operating end portion;

a second arm having an axially supporting portion for axially supporting the drive cam opposed roller and a fulcrum end portion remote from the axially supporting portion by a predetermined amount for receiving a switch operating force for displacing a position of bringing the drive cam opposed roller and the drive cam into contact with each other frontward/rearward in the direction of rotating the drive cam;

a fulcrum moving mechanism having a fulcrum member engaged with the fulcrum end portion of the second arm for displacing the second arm by receiving the switch operating force from a drive source; and a third arm axially supported by a supporting shaft arranged at a vicinity of the cam shaft at an axially supporting end portion and formed with a rocking cam face capable of exerting the opening/closing operating force of the rocker arm roller at a rocking end of a rocking extended portion extended from the axially supporting end portion.

5. The variable valve apparatus of an interval combustion engine according to claim 4, wherein a cam projected face curvature at a vicinity of a cam top of the drive cam is set to be smaller on a side of the down section than on a side of the up section.

6. The variable valve apparatus of an internal combustion engine according to claim 4, wherein in the down section of the cam lift face of the drive cam, a post section of the down section is formed by a shape by which an amount of operating a member driven by the drive cam can maintain a positive acceleration having substantially a constant value.

* * * * *

UNITED STATES PATENT AND TRADEMARK OFFICE

CERTIFICATE OF CORRECTION

PATENT NO. : 7,290,512 B2
APPLICATION NO. : 11/375098
DATED : November 6, 2007
INVENTOR(S) : Shinichi Murata It is certified that error appears in the above-identified patent and that said Letters Patent is hereby corrected as shown below:

In column 10, line 67:
"an up section" should read --a down section--.

In column 11, line 1:
"a down section" should read --an up section--.

Signed and Sealed this

Fourteenth Day of April, 2009

JOHN DOLL
*Acting Director of the United States Patent and Trademark Office*